US006927373B2

(12) United States Patent
Jeon

(10) Patent No.: US 6,927,373 B2
(45) Date of Patent: Aug. 9, 2005

(54) COOKING APPARATUS EQUIPPED WITH AUDIO PLAYER

(75) Inventor: Sei Ill Jeon, Kimpo (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/612,420

(22) Filed: Jul. 3, 2003

(65) Prior Publication Data

US 2004/0164073 A1 Aug. 26, 2004

(30) Foreign Application Priority Data

Feb. 22, 2003 (KR) ..... 10-2003-0011229

(51) Int. Cl.[7] ..... H05B 6/66
(52) U.S. Cl. ..... 219/702; 219/387; 219/714
(58) Field of Search ..... 219/702, 714, 219/720, 387; 99/325; 434/321; 360/1, 12; 340/692, 505, 425.5; 206/542

(56) References Cited

U.S. PATENT DOCUMENTS 1,377,092 A * 5/1921 Phaneuf ..... 219/387
4,279,342 A * 7/1981 Van Pelt ..... 206/542
4,349,715 A * 9/1982 Mariyama ..... 219/714
4,630,160 A * 12/1986 Murayama ..... 360/137
5,506,563 A * 4/1996 Jonic ..... 340/426.34
5,946,343 A * 8/1999 Schotz et al. ..... 375/141
5,981,929 A * 11/1999 Maeda et al. ..... 219/757

FOREIGN PATENT DOCUMENTS

JP 08233287 A * 9/1996 ..... F24C/7/08
KR 1996-3258 3/1996
KR 1999-1379 1/1999
KR 2002-25118 4/2002

* cited by examiner

*Primary Examiner*—Quang T. Van
(74) *Attorney, Agent, or Firm*—Staas & Halsey LLP

(57) ABSTRACT

A cooking apparatus including an audio player; a body with a player seat to which the audio player is attached and from which the audio player is detached; and at least one speaker to output sound signals reproduced by the audio player. The cooking apparatus of the present invention improves installation/removal and operation of the audio player, and expands the range of use thereof.

20 Claims, 6 Drawing Sheets

COOKING APPARATUS EQUIPPED WITH AUDIO PLAYER

CROSS-REFERENCE TO RELATED APPLICATIONS

This application claims the benefit of Korean Application No. 2003-11229, filed Feb. 22, 2003, in the Korean Intellectual Property Office, the disclosure of which is incorporated herein by reference.

BACKGROUND OF THE INVENTION

1. Field of the Invention

The present invention relates, in general, to a cooking apparatus and, more particularly, to a microwave oven having an audio player.

2. Description of the Related Art

Generally, a microwave oven is an apparatus that cooks food by radiating microwaves into a cooking cavity. A microwave oven is partitioned into an electrical component area and a cooking cavity. In the electrical component area, a magnetron generates microwaves. As use of the microwave oven increases, the amount of time a user spends cooking with the microwave oven also increases. Therefore, if the user, who frequently uses the microwave oven, listens to desired music while cooking, the user would enjoy cooking more. An audio player and microwave oven combination to satisfy the desire of the user is disclosed in Korean Utility Model Laid-Open No. 1999-1379.

FIG. 1 is a perspective view of a conventional microwave oven having an audio player, as disclosed in Korean Utility Model Laid-Open No. 1999-1379. As shown in FIG. 1, speakers 20 are disposed on both sides of an upper surface of a body 10, and a depressed seat 12 is formed at a center portion of the upper surface of the body 10. A compact disc (CD) player 30 and a cassette player 40 are installed in the depressed seat 12. When a user cooks food using the microwave oven, the user puts food on a cooking tray in a cooking cavity, selects a suitable cooking time corresponding to the food, and starts cooking. When the user selects one of the CD player 30 and the cassette player 40 installed in the body 10 to play music while cooking the food, the sound is output through the speakers 20.

The conventional audio player and microwave oven combination having the above construction is problematic in that, because the CD player and the cassette player are installed in the upper portion of the microwave oven, it is very inconvenient for a short user to manipulate the CD player or the cassette player if the installation position of the microwave oven is relatively high. Because a range hood and microwave oven combination is installed higher than a cooktop, the problem becomes more serious.

Further, the conventional audio payer and microwave oven combination is problematic in that, because the CD player and the cassette player are fixedly installed in the microwave oven, the user may not use the CD player and the cassette player if the user leaves the location where the microwave oven is installed. That is, the range of use of the CD player that are and the cassette player fixedly installed in the microwave oven is very limited.

SUMMARY OF THE INVENTION

It is an aspect of the present invention to provide a cooking apparatus equipped with an audio player, in which the installation position and manner of the audio player is improved to facilitate the manipulation of the audio player and expand the range of use thereof.

Additional aspects and/or advantages of the invention will be set forth in part in the description which follows and, in part, will be obvious from the description, or may be learned by practice of the invention.

To achieve the above and/or other aspects of the present invention, there is provided a cooking apparatus including an audio player; a body with a player seat to which the audio player is attached and from which the audio player is detached; and at least one speaker to output sound signals reproduced by the audio player.

To achieve the above and/or other aspects according to the present invention, there is provided a microwave oven including an electrical component area having a magnetron and a power supply unit; an audio player; a body with a player seat to which the audio player is attached and from which the audio player is detached; and at least one speaker to output sound signals reproduced by the audio player.

To achieve the above and/or other aspects according to the present invention, there is provided an audio player for a cooking apparatus having a body with a player seat detachably receiving the audio player and a player seat connector, the audio player including an audio player connector to electrically connect the audio player to the player seat, the audio player connector receiving power through the player seat connector and transmitting sound signals; a control panel on an upper surface of the audio player to control operation of the audio player; and a wireless transmitting/receiving device to communicate with the cooking apparatus when the audio player is detached from the player seat.

To achieve the above and/or other aspects according to the present invention, there is provided a method of attaching and detaching an audio player with an audio player connector to and from a cooking apparatus, the audio player having an audio player connector and a control panel on an upper surface thereof, and the cooking apparatus having a body with a player seat and a player seat connector and an ejection button, the method including attaching the audio player by inserting the audio player into the player seat, with the audio player connector interlocking with the player seat connector, and pushing the audio player toward the cooking apparatus, with a top end of the audio player rotating into the body of the cooking apparatus; and detaching the audio player by pressing the ejection button, the top end of the audio player rotating away from the cooking apparatus, and removing the audio player from the player seat.

These, together with other aspects and/or advantages that will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and other aspects and/or advantages of the present invention will become apparent and more readily appreciated from the following description of the preferred embodiments, taken in conjunction with the accompanying drawings, of which.

DESCRIPTION OF THE PREFERRED EMBODIMENTS

Figure 1:
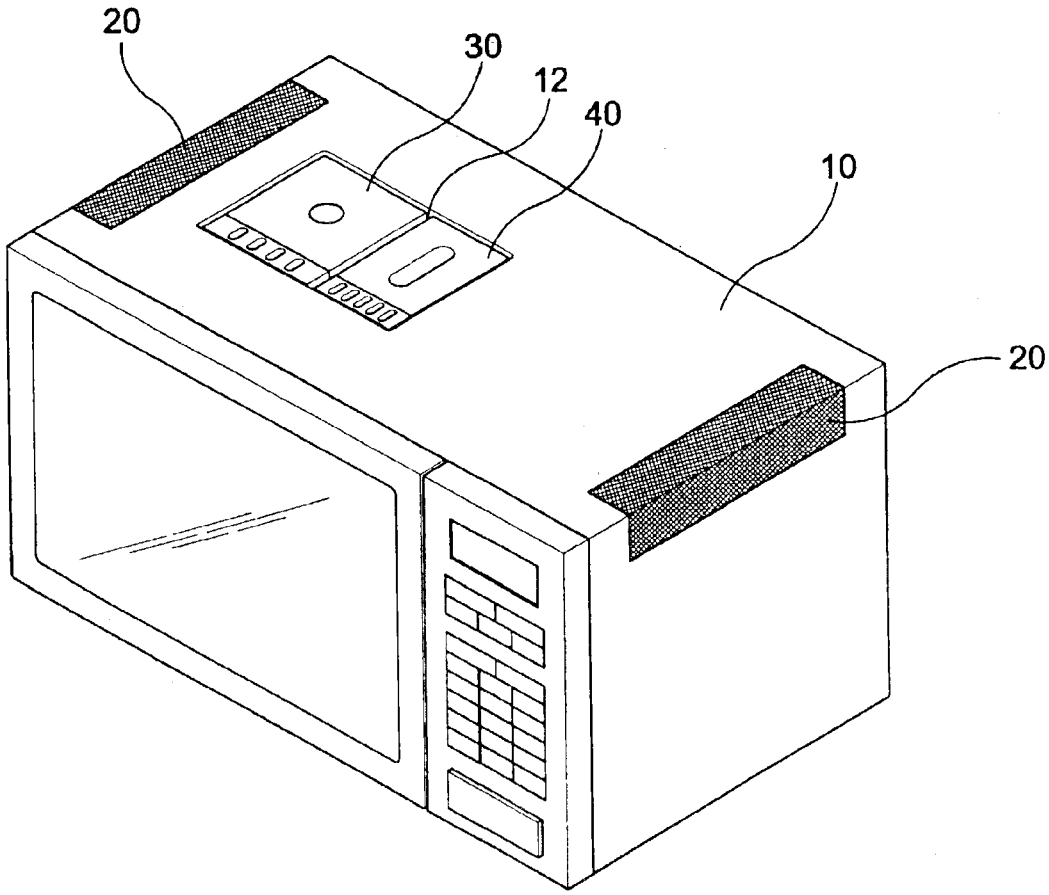
FIG. 1 PRIOR ART
FIG. 1 is a perspective view of a conventional microwave oven having an audio player.

Hereinafter, embodiments of the present invention will be described in detail with reference to the attached drawings, wherein the like reference numerals refer to the like elements throughout the present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Embodiments of a cooking apparatus having an audio player according to the present invention are described in detail with reference to FIGS. 2 through 6.

Figure 2:
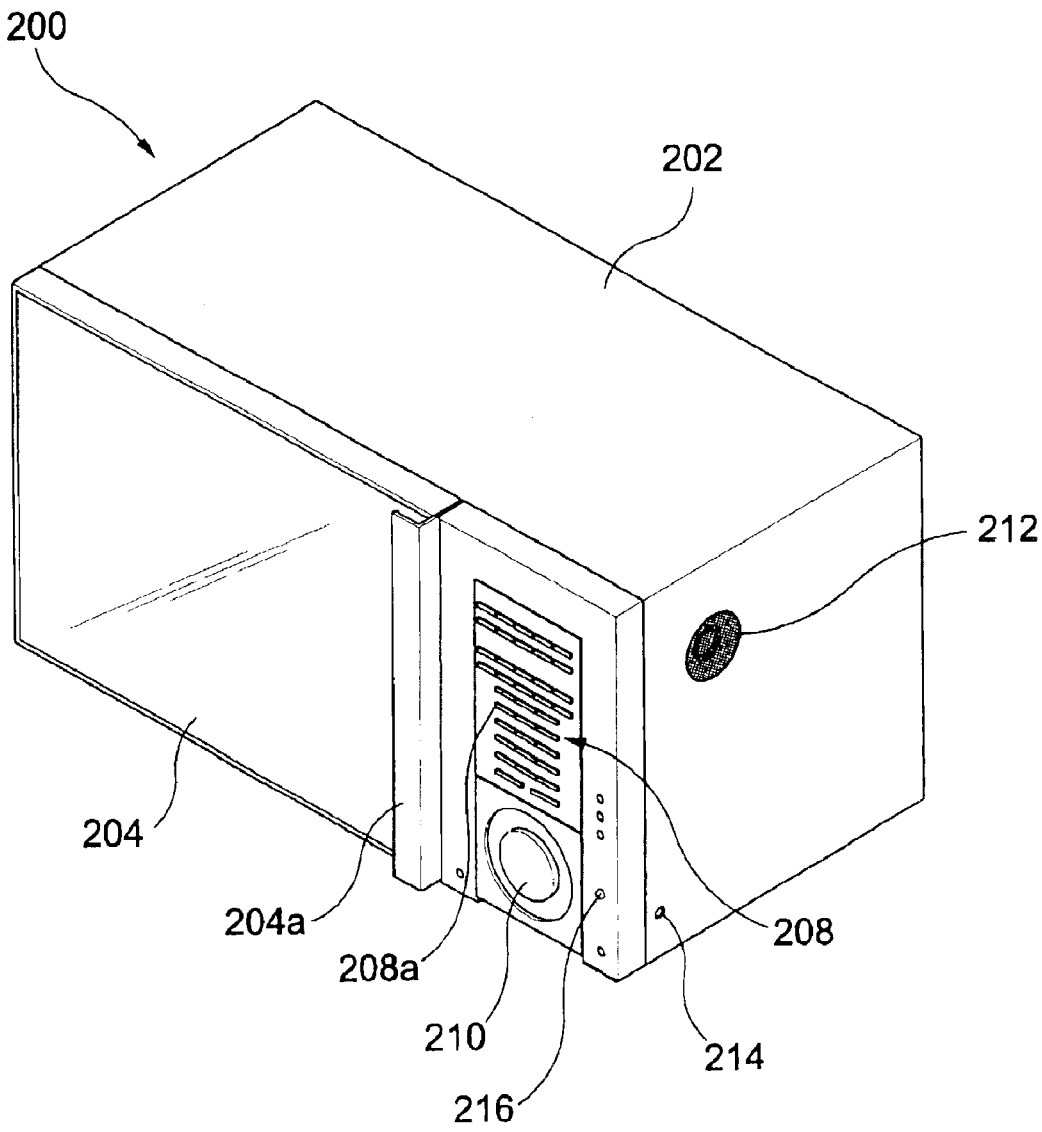
FIG. 2 is a perspective view of a cooking apparatus having an audio player, according to an embodiment of the present invention.

FIG. 2 is a perspective view of a cooking apparatus having an audio player according to an embodiment of the present invention, wherein a microwave oven having a CD player installed in the front thereof is depicted. As shown in FIG. 2, in the front of a body 202 of a microwave oven 200, a door 204 to allow a user to selectively open and close a cooking cavity (not shown), a microwave oven control panel 208, and a CD player 210 are installed. The door 204 has a door handle 204*a* that is bent in a direction away from the CD player 210 so that the door handle 204*a* does not interfere with the user attaching and detaching the CD player 210 to and from the body 202 of the microwave oven 200.

The microwave oven control panel 208 has a plurality of input devices 208*a* required to set cooking modes of the microwave oven 200 Each of the input devices 208*a* is implemented, for example, as a heat-sensing touch switch. That is, by only touching the input devices 208*a*, the input operation desired by the user may be performed.

The input devices 208*a* include an eject button to eject and remove the CD player 210 from the body 202. Because the CD player 210 is installed in the front of the body 202, it is convenient for the user to use the CD player 210, even though the microwave oven 200 may be installed in a high position relative to the height of the user. The CD player 210 is attached to and detached from a player seat 220 (FIG. 5) formed in the front of the body 202 so that the CD player 210 is freely removable.

Speakers 212 are mounted in both sides of the body 202 to allow sound signals reproduced by the CD player 210 to be output through the speakers 212. Further, an audio output terminal 214 is formed in one side of the body 202 so that other external audio output devices, such as an external speaker (not shown), may be connected to the audio output terminal 214. The microwave oven 200 is constructed so that a Mini Disc (MD) player, a cassette player, an MPEG layer 3 (MP3) player, etc., as well as the CD player 210, may be installed on the player seat of the microwave oven 200 of the present invention for use by the user. A wireless transmitting/receiving device 216 provided in the front of the body 202 receives sound signals reproduced by the CD player 210 and transmits a control signal to control the CD player 210 when the user removes the CD player 210 from the body 202 and moves to another location in the user's home while carrying the CD player 210.

Figure 3:
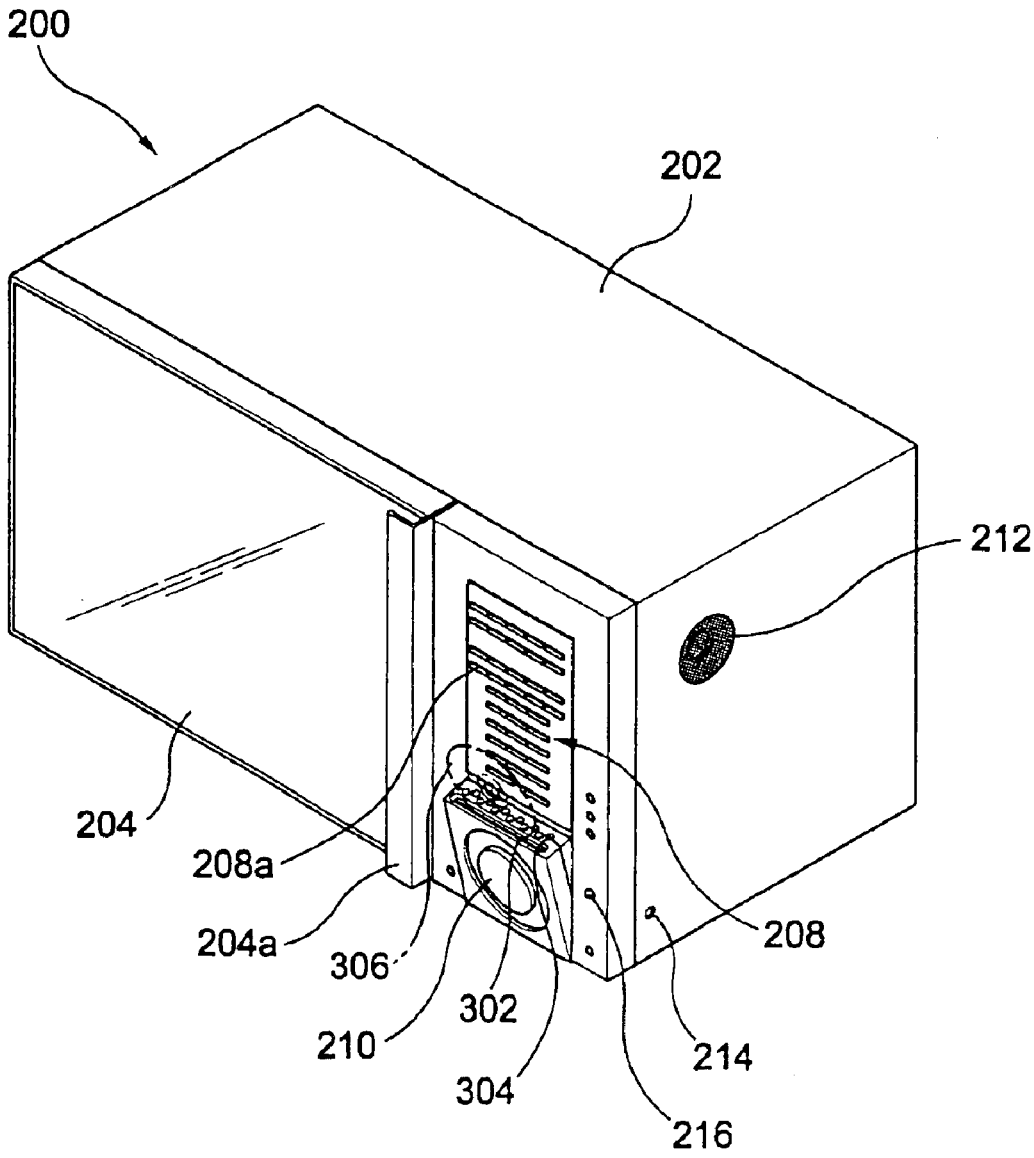
FIG. 3 is a perspective view showing use of the cooking apparatus of FIG. 2.

FIG. 3 is a perspective view showing use of the microwave oven 200 of FIG. 2. As shown in FIG. 3, if the user manipulates the eject button on the microwave oven control panel 208, an upper portion of the CD player 210 rotates forward to a predetermined angle for ejection from the body 202. On the upper surface of the CD player 210 are a CD player control panel 304 to allow the user to manipulate the CD player 210, and a CD insertion slit 302 in which a CD 306 is inserted. If the upper portion of the CD player 210 is ejected, the CD player control panel 304 and the CD insertion slit 302 face upward at an angle with respect to the front of the body 202, allowing convenient insertion of the CD 306 into the CD insertion slit 302 and manipulation of the CD player control panel 304. An additional CD player control panel (not shown) may be provided on the microwave oven control panel 208 to allow operation of the CD player 210, even when the CD player 210 is not ejected, thus increasing the convenience in use of the CD player 210.

Figure 4:
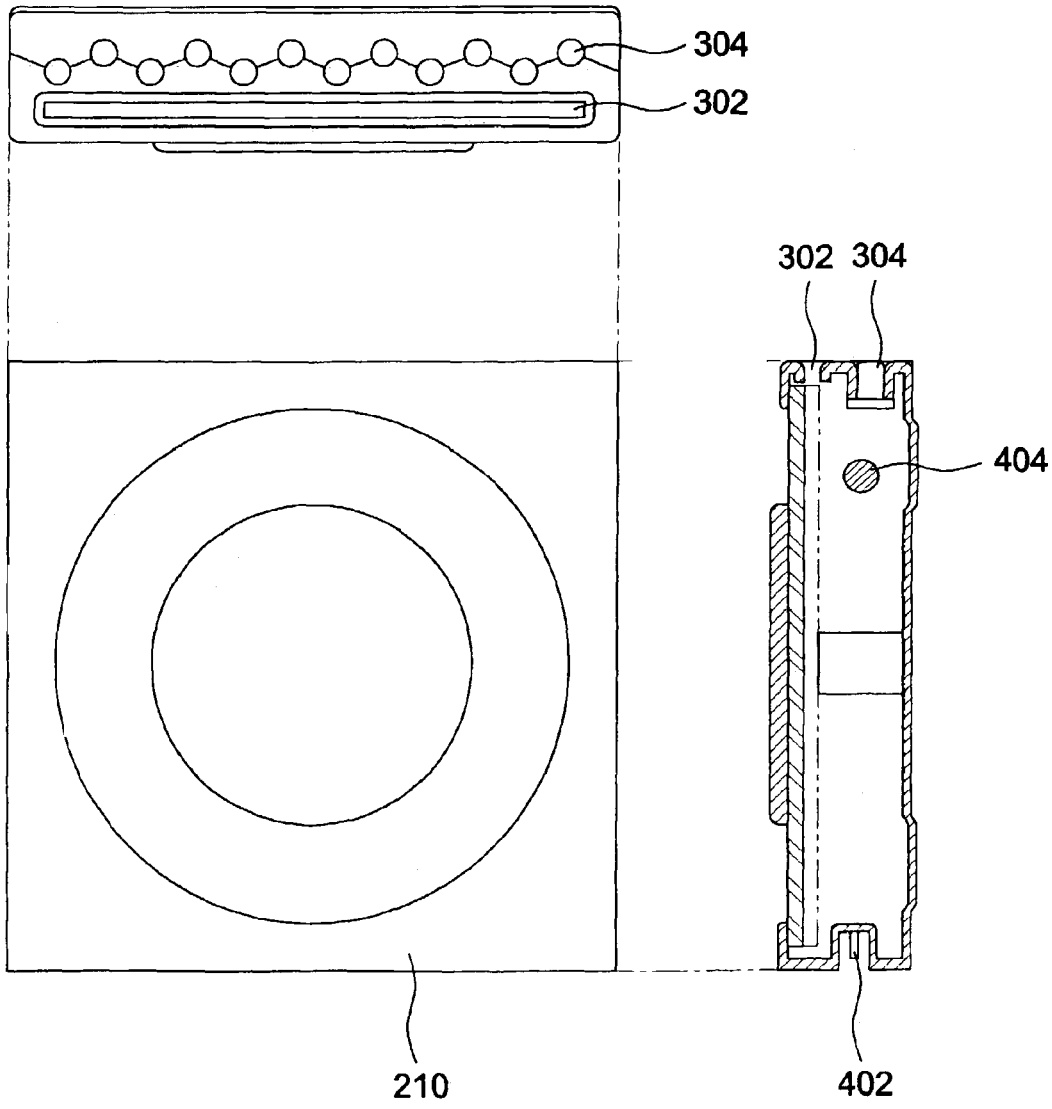
FIG. 4 shows views of the audio player of FIG. 2.

FIG. 4 shows views of the CD player 210 of FIG. 2. As shown in FIG. 4, a first connector 402 in a lower portion of the CD player 210 is supplied with power and transmits sound signals. The first connector 402 also allows the CD player 210 to be installed on the player seat of the body 202 and to be electrically connected to the body 202. A wireless transmitting/receiving device 404 in the side of the CD player 210 transmits sound signals reproduced by the CD player 210 to the body 202 and receives a control signal to control the CD player 210 from the body 202 when the user removes the CD player 210 from the body 202 and moves to another location in the user's home while carrying the CD player 210. The CD player 210 is powered by a battery when it is removed from the body 202.

In the cooking apparatus having the audio player according to the present invention, in one instance, a wireless communication device is provided in each audio player attached to the microwave oven body 202 to enable the user to listen to music through the audio player, even when the user removes the audio player from the body of the microwave oven 200 and moves to another location in the user's home while carrying the audio player. For example, a Radio Frequency (RF) transceiver, a Bluetooth device, an infrared communication device, etc., may be used as the wireless communication device.

Figure 5:
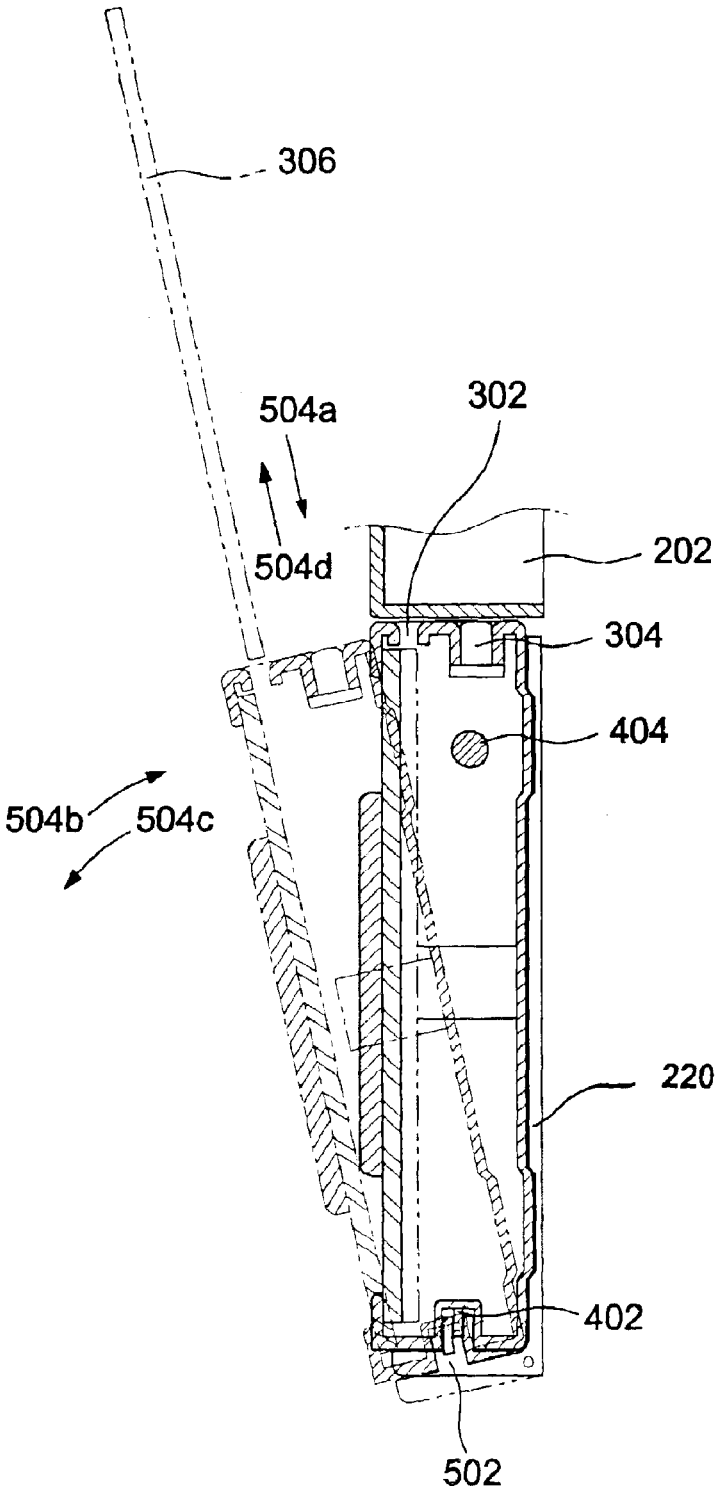
FIG. 5 is a view showing the attachment and detachment of the audio player of FIG. 4.

FIG. 5 is a view showing the attachment and detachment of the CD player 210 of FIG. 4. As shown in FIG. 5, a second connector 502 on a lower portion of the player seat of the body 202, on which the CD player 210 is installed, provides power to the CD player 210 and receives sound signals reproduced by the CD player 210. The sound signals reproduced by the CD player 210 are transmitted to an amplifier (not shown) through the first and second connectors 402 and 502 and amplified by the amplifier. The amplified sound signals are output through the speakers 212.

In FIG. 5, arrows 504*a*, 504*b*, 504*c*, and 504*d* designate inserting, installing, ejecting, and removing directions of the CD player 210, respectively. To install the CD player 210 in the body 202, the user inserts the CD player 210 in the direction 504*a* to interlock the first connector 402 of the CD player 210 with the second connector 502 of the player seat, and then pushes the CD player 210 in the direction 504*b* to engage the CD player 210 with the player seat of the body 202. To detach the CD player 210 from the body 202, the user presses the eject button of the microwave oven control panel 208 to eject the CD player 210 in the direction 504*c*, and removes the CD player 210 in the direction 504*d*.

Figure 6:
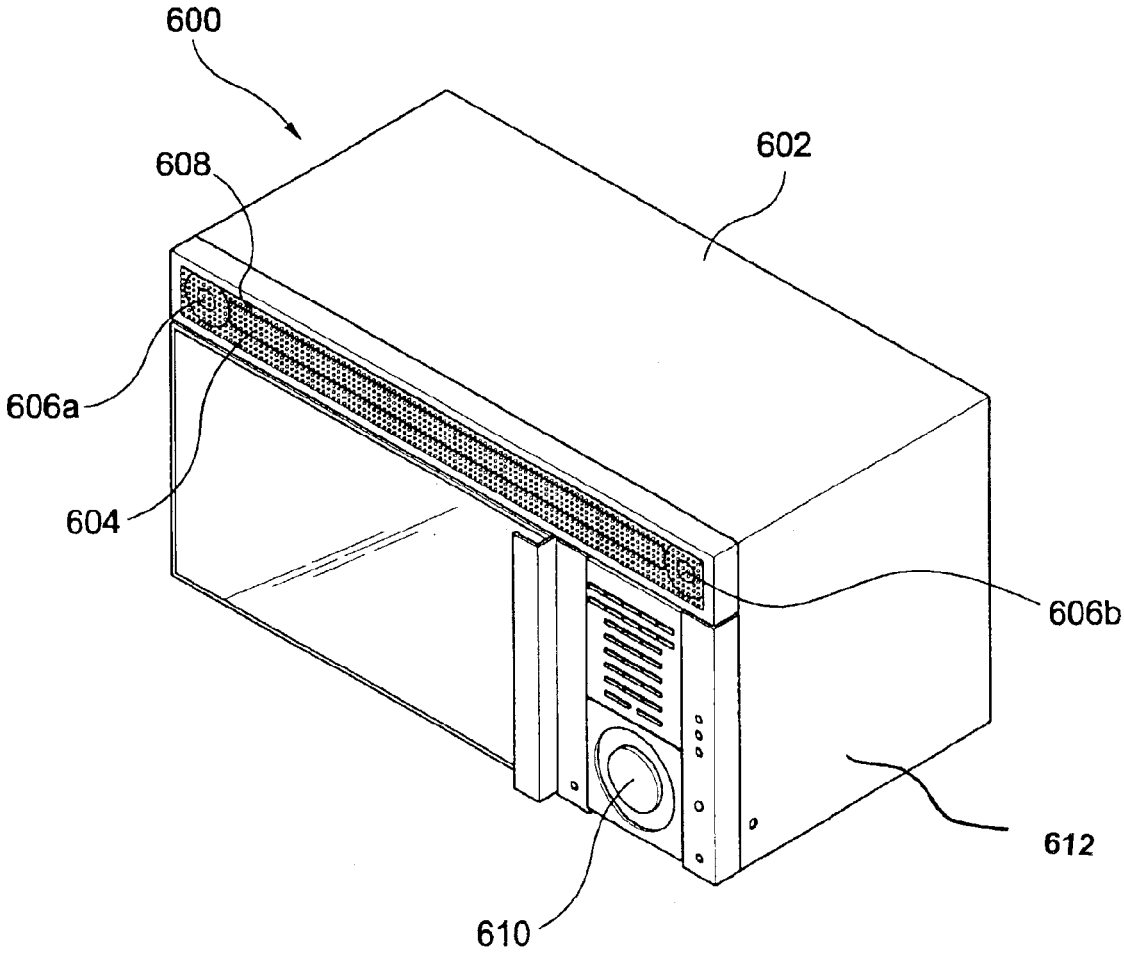
FIG. 6 is a perspective view of a cooking apparatus having an audio player, according to another embodiment of the present invention.

FIG. 6 is a perspective view of a cooking apparatus having an audio player according to another embodiment of the present invention, wherein a range hood and microwave oven combination with an audio player is depicted. As shown in FIG. 6, an air inlet 604 is formed in the front of a body 602 of a range hood and microwave oven combination 600. Further, a grille 608 is installed in front of the air inlet 604 to prevent impurities from flowing into the air inlet 604. Air drawn through the air inlet 604 cools a magnetron and high voltage devices of an electrical component area 612. A pair of speakers 606*a* and 606*b* are mounted in both sides of the air inlet 604. Sound signals reproduced by a CD player 610 are output through the speakers 606*a* and 606*b*.

As described above, the present invention provides a cooking apparatus having an audio player, in which the audio player is installed in the front of a body of the cooking apparatus, allowing convenient manipulation of the audio player, even when the cooking apparatus is installed at a high position relative to the height of a user. Further, the present invention is advantageous in that the audio player is detachable, thus greatly increasing the range of use of the audio player.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus, comprising:

an audio player;

a body with a player seat to which the audio player is attached and from which the audio player is detached; and at least one speaker to output sound signals reproduced by the audio player, wherein:

the body further comprises an eject button to remove the audio player attached to the player seat; and an upper portion of the audio player rotates away from the cooking apparatus when the audio player is ejected.

2. The cooking apparatus according to claim 1, wherein the audio player is located in a front of the cooking apparatus.

3. The cooking apparatus according to claim 2, further comprising a door with a handle extending away from the audio player to not interfere with attachment and detachment of the audio player.

4. The cooking apparatus according to claim 1, wherein the player seat is formed in a front of the body.

5. The cooking apparatus according to claim 1, wherein:

the audio player comprises a control panel on an upper surface thereof to allow a user to manipulate the audio player; and the control panel rotates away from the cooking apparatus when the audio player is ejected.

6. The cooking apparatus according to claim 5, wherein the audio player is closed by rotating the audio player toward the cooking apparatus, the audio player control panel being covered when the audio player is closed, and the audio player is opened by rotating the audio player away from the cooking apparatus, the audio player control panel being exposed when the audio player is opened.

7. The cooking apparatus according to claim 6, further comprising another audio player control panel located on the body to operate the audio player when the audio player is closed.

8. The cooking apparatus according to claim 1, further comprising:

wireless transmitting/receiving units respectively in both the audio player and the body, wherein the audio player and the body communicate with each other through the wireless transmitting/receiving unit of the audio player and the wireless transmitting/receiving unit of the body when the audio player is detached from the body.

9. The cooking apparatus according to claim 1, wherein the audio player is a mini disc player, a cassette player, an MPEG layer 3 player, or a CD player.

10. A microwave oven, comprising:

an electrical component area comprising a magnetron and a power supply unit;

an audio player;

a body with a player seat to which the audio player is attached and from which the audio player is detached; and at least one speaker to output sound signals reproduced by the audio player, wherein:

the body further comprises an eject button to remove the audio player attached to the player seat; and an upper portion of the audio player rotates away from the cooking apparatus when the audio player is ejected.

11. The microwave oven according to claim 10, wherein the player seat is formed in a front of the body.

12. The microwave oven according to claim 10, wherein:

the audio player comprises a control panel on an upper surface thereof to allow a user to manipulate the audio player; and the control panel rotates away from the cooking apparatus when the audio player is ejected.

13. The microwave oven according to claim 10, further comprising:

wireless transmitting/receiving units respectively in both the audio player and the body, wherein the audio player and the body communicate with each other through the wireless transmitting/receiving unit of the audio player and the wireless transmitting/receiving unit of the body when the audio player is detached from the body.

14. The microwave oven according to claim 10, wherein the microwave oven is combined with a range hood.

15. A microwave oven, comprising:

an electrical component area comprising a magnetron and a power supply unit;

an audio player;

a body with a player seat to which the audio player is attached and from which the audio player is detached; and at least one speaker to output sound signals reproduced by the audio player, wherein the body includes a grille formed in the body to draw external air used to cool the electrical component area, and wherein the one or more speakers are installed behind the grille.

16. The microwave oven according to claim 15, wherein the grille is formed on a front of the body.

17. The microwave oven according to claim 16, further comprising an air inlet installed behind the grille to draw air to cool the electrical component area, the grille preventing impurities from flowing into the air inlet.

18. The microwave oven according to claim 17, wherein two speakers are mounted at both sides of the air inlet.

19. A method of attaching and detaching an audio player with an audio player connector to and from a cooking apparatus, the audio player having an audio player connector and a control panel on an upper surface thereof, and the cooking apparatus having a body with a player seat and a player seat connector and an ejection button, the method comprising:

attaching the audio player by inserting the audio player into the player seat, with the audio player connector interlocking with the player seat connector, and pushing the audio player toward the cooking apparatus, with a top end of the audio player rotating into the body of the cooking apparatus; and detaching the audio player by pressing the ejection button, the top end of the audio player rotating away from the cooking apparatus, and removing the audio player from the player seat.

20. The method according to claim 19, further comprising:

closing the audio player by rotating the audio player toward the cooking apparatus after attaching the audio player to the cooking apparatus, the control panel being covered when the audio player is closed; and opening the audio player, when the audio player is closed, by rotating the audio player away from the cooking apparatus, the control panel being exposed when the audio player is opened.

* * * * *